United States Patent [19]

Besselman

[11] Patent Number: 4,533,596

[45] Date of Patent: Aug. 6, 1985

[54] THERMAL MAGNETIC TRANSFER RIBBON

[75] Inventor: Thomas P. Besselman, Dayton, Ohio

[73] Assignee: NCR Corporation, Dayton, Ohio

[21] Appl. No.: 508,630

[22] Filed: Jun. 28, 1983

[51] Int. Cl.[3] ..... B41M 5/26

[52] U.S. Cl. ..... 428/341; 400/120; 428/488.1; 428/692; 428/900; 428/913; 428/914

[58] Field of Search ..... 106/31; 428/206–209, 428/329, 484, 488, 692, 900, 913, 914, 336, 341; 400/120, 241

[56] References Cited

U.S. PATENT DOCUMENTS 3,284,360 11/1966 Peshin ..... 428/900

3,484,264 12/1969 Strauss et al. ..... 106/31

*Primary Examiner*—Bruce H. Hess

*Attorney, Agent, or Firm*—Wilbert Hawk, Jr.; Albert L. Sessler, Jr.; George J. Muckenthaler

[57] ABSTRACT

A thermal magnetic transfer ribbon includes a substrate and a coating containing resin, oil and wax in a binder mix which is dispersed with a magnetic pigment in a solvent solution.

16 Claims, 2 Drawing Figures

THERMAL MAGNETIC TRANSFER RIBBON

BACKGROUND OF THE INVENTION

In the printing field, the impact type printer has been the predominant apparatus for providing increased thruput of printed information. The impact printers have included the dot matrix type wherein individual print wires are driven from a home position to a printing position by individual and separate drivers, and the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine-readable in a subsequent operation. One of the known encoding systems is MICR (magnetic ink character recognition) utilizing the manner of operation as just mentioned.

While the impact printing method has dominated the industry, one disadvantage of this type printing is the noise level which is attained during printing operation. Many efforts have been made to reduce the high noise levels by use of sound absorbing or cushioning materials or by isolating the printing apparatus. More recently, the advent of thermal printing which effectively and significantly reduces the noise levels has brought about the requirement for heating of extremely precise areas of the record media by use of relatively high currents. The intense heating of the localized areas causes transfer of ink from a ribbon onto the paper or alternatively, the paper may be of the thermal type which includes materials which are responsive to the generated heat.

Further, it is seen that the use of thermal printing is adaptable for MICR encoding of documents wherein magnetic particles are caused to be transferred onto the documents for machine reading of the characters. The thermal transfer printing approach for use in MICR encoding of documents enables reliability in operation at the lower noise levels.

Representative documentation in the area of magnetic ink for use in non-impact printing includes UK patent application No. 2106038A, published Apr. 7, 1983, which discloses a heat-sensitive magnetic transfer element for printing a magnetic image to be recognized by a magnetic ink character reader and which element comprises a heat-resisting foundation and a heat-sensitive transfer layer including a magnetic powder in a wax or plastic binder and having a melting point of 50 degrees to 120 degrees C. so that portions of the layer can be transferred onto a receiving paper in the form of a magnetic image by a thermal printer.

U.S. Pat. No. 3,042,616, issued to R. J. Brown on July 3, 1962, discloses a process of preparing magnetic ink by wetting powdered iron with a resinous solution and adding an aqueous slurry of carbonate to form droplets surrounded by solvent liquid. The solvent is separated by water and the particles are then filtered and dried to produce spheres of magnetic ink.

U.S. Pat. No. 3,117,018, issued to E. Strauss on Jan. 7, 1964, discloses a color transfer medium and method of producing the same by applying a coating consisting of a polycarbonate, a solvent, a plasticizer and a pigment, and then drying the coating to form a solid transfer layer.

U.S. Pat. No. 3,413,183, issued to H. T. Findlay et al. on Nov. 26, 1968, discloses a transfer medium provided by a coating process wherein the transfer layer is a polycarbonate having voids which hold an imaging material.

U.S. Pat. No. 3,744,611, issued to L. Montanari et al. on July 10, 1973, discloses an electrothermal printer for non-impact printing on plain paper that uses a ribbon made of a substrate having a thermal-transferable ink coated on one surface thereof and a coating of electrically resistive material on the other surface.

U.S. Pat. No. 3,855,448, issued to T. Hanagata et al. on Dec. 17, 1974, discloses a print ribbon comprising a heat-resistant support sheet with a heat-fusible material layer of thermoplastic resin, carbon black, pigment or oleic acid fats, and wax, mineral oils or vegetable oils.

U.S. Pat. No. 4,022,936, issued to R. E. Miller et al. on May 10, 1977, discloses a process for making a sensitized record sheet by providing a substrate, coating the substrate with an aqueous composition, and then drying the coating.

U.S. Pat. No. 4,103,066, issued to G. F. Brooks et al. on July 25, 1978, discloses a ribbon for non-impact printing comprising a transfer coating and a substrate which is a polycarbonate resin containing a percentage by weight of electrically-conductive carbon black.

U.S. Pat. No. 4,251,276, issued to W. I. Ferree et al. on Feb. 17, 1981, discloses a transfer ribbon having a substrate coated with a thermally-activated ink composition comprising a thermally-stable polymer, an oil-gelling agent, and an oil dissolving medium present in a percentage by weight of the total nonvolatile components.

U.S. Pat. No. 4,291,994, issued to T. L. Smith et al. on Sept. 29, 1981, discloses a ribbon for non-impact printing which comprises a transfer coating and a substrate containing resin which is a mixture of polycarbonate, a block copolymer of bisphenol carbonate and dimethyl siloxane, and a percentage by weight of electrically conductive carbon black.

And, U.S. Pat. No. 4,309,117, issued to L. S. Chang et al. on Jan. 5, 1982, discloses a ribbon configuration for resistive ribbon thermal transfer printing comprising a low resistive layer of conductive carbon, a high resistive layer of a ceramic metal mixture, a stainless steel conductive layer, and an ink transfer layer.

SUMMARY OF THE INVENTION

The present invention relates to non-impact printing. More particularly, the invention provides a thermal magnetic ribbon or transfer medium for use in encoding characters on paper or like record media documents which enables machine reading of the encoded characters. The thermal magnetic transfer ribbon makes use of the advantages of thermal printing while encoding documents with a magnetic signal inducible ink. The ribbon comprises a thin, smooth substrate such as tissue-type paper or polyester-type plastic on which is applied a coating that generally includes a magnetic pigment and a wax mixture dispersed in a binder mix of resin. The resin and the solids are mixed into solution along with a magnetic filler and the wax mixture is added after wetting the pigment. The coating is then put through a setting procedure by drying the coating at an elevated temperature.

In view of the above discussion, the principal object of the present invention is to provide a ribbon including a thermal magnetic coating thereon.

Another object of the present invention is to provide a thermal magnetic transfer ribbon including a coating thereon for use in encoding operations.

An additional object of the present invention is to provide a magnetic coating on a ribbon having ingredients in the coating which are responsive to heat for transferring the coating to paper or like record media.

A further object of the present invention is to provide a coating on a ribbon substrate, which coating includes a magnetic pigment and a wax mixture dispersed in a binder mix and which is responsive to heat for transferring the coating in precise printing manner to paper or like record media.

Still another object of the present invention is to provide a thermally-activated coating on a ribbon that is completely transferred from the base of the ribbon onto the paper or document in an encoding operation in printing manner at precise positions and during the time when the thermal elements are activated.

Additional advantages and features of the present invention will become apparent and fully understood from a reading of the following description taken together with the annexed drawing.

DESCRIPTION OF THE PREFERRED EMBODIMENT

Figure 1:
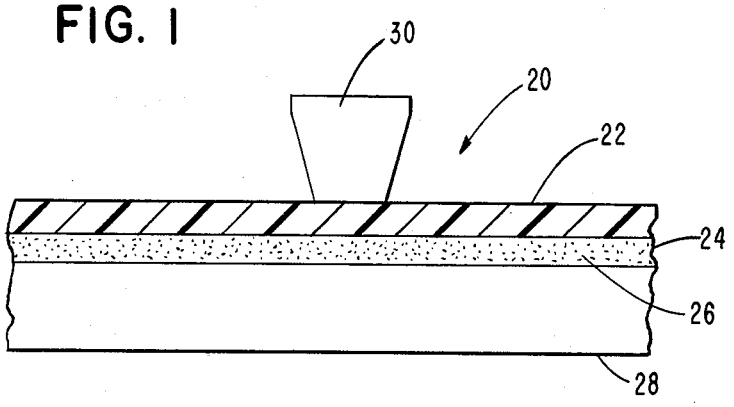
FIG. 1 illustrates a thermal element operating with a ribbon base having a transfer coating thereon incorporating the ingredients as disclosed in the present invention.
Figure 2:
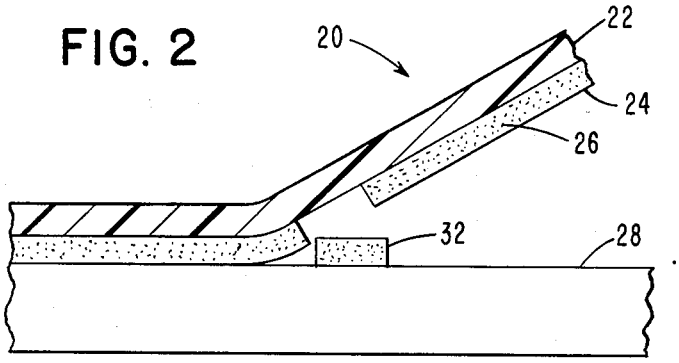
FIG. 2 shows the receiving paper with a coating particle transferred thereto.

The transfer ribbon 20, as illustrated in FIGS. 1 and 2, comprises a base or substrate 22 of thin, smooth tissue-type paper or polyester-type plastic or like material having a coating 24 which is thermally activated and includes magnetic particles 26 as an ingredient therein for use in encoding operations to enable machine reading of characters. Each character that is imaged on a receiving paper 28 or like record media produces a unique magnetic waveform that is recognized and read by the reader.

As alluded to above, it is noted that the use of thermal printer having a print head element, as 30, substantially reduces noise levels in the printing operation and provides reliability in MICR encoding of paper or like documents 28. The thermal magnetic transfer ribbon 20 enables the advantages of thermal printing while encoding the document 28 with a magnetic signal inducible ink. When the heating elements 30 of a thermal print head are activated, the encoding operation requires that the magnetic particles or like material 26 on the coated ribbon 20 be completely transferred from the ribbon to the document 28 in manner and form to produce precisely defined characters 32 for recognition by the reader.

The coating of the present invention basically consists of a heated mixture to which is added a solids mixture, the two mixtures having ingredients of appropriate amounts making up the formulation. The heated mixture consists of the following ingredients in a raw coating sample weight of 100 grams.

Resin: 0–10 g,
Oil: 1.5–5 g,
Wax: 15–50 g,
Additives: 0–5 g,
Solvent: 30–60 g.

In the solvent based coating, the above ingredients are combined in appropriate amounts and the solvent coating mixture is stirred while being heated to approximately 80 degrees C. for 10 minutes. The heated mixture is added along with the solids mixture to the dispersion equipment while the temperature is still at approximately 80 degrees C.

The solvent coating solids mixture composition includes the following ingredients:

Pigment: 12–50 g,
Wetting agents: 0.5–3 g.

After the solids mixture and the solvent based heated mixture are added to the dispersion unit, the combined mixture is ground for a sufficient amount of time to insure good pigment wetting and to reduce size and condition of agglomerates. During the dispersion process the temperature of the coating is maintained at approximately 55 degrees C.

In the case of a hot melt coating, the heated mixture consists of the following ingredients:

Resin: 3–15 g,
Wax: 15–60 g,
Additives: 0–5 g.

This mixture is melted and stirred to uniformly distribute all the ingredients and is maintained at a temperature of approximately 120 degrees C.

The solids mixture for the hot melt coating consists of the following ingredients:

Pigment: 25–50 g,
Oil: 0–10 g,
Additives: 0–5 g,
Solvent: 50–100 g.

This solids mixture of ingredients is ground in the dispersion equipment for a sufficient length of time to wet out the pigment and to reduce the size and condition of the agglomerates. The solids mixture is then slowly added to the hot melt coating heated mixture and is stirred to insure good mixing of all the ingredients. The solvent ingredient of the solids mixture evaporates when it is added to the 120 degrees C. heated mixture.

After the coating 24 has been applied to the substrate 22, the transfer ribbon 20 is passed through a dryer at an elevated temperature in a range between 93 degrees and 150 degrees C. for approximately five to ten seconds to provide good adherence of the coating onto the substrate.

Having disclosed generally the ingredients which make up the coating of the present invention, the following examples teach specific formulations of the coating. A preferred formulation and method of making the coating is in accordance with the following example.

EXAMPLE I

Example I is a composition and method of making a heat sensitive transfer layer or coating 24 for the substrate 22 to a coating weight between 7.7 and 13.5 grams per square meter. The composition, based on a weight of 100 kilograms of raw coating, includes the following two basic mixtures, namely, a heated mix and a solids mix.

| Material | Trade Name | Percent Dry Weight |
|---|---|---|
| HEATED MIX FORMULATION | | |
| Hydrocarbon Resin | Picco 6100 | 10 |
| Petroleum Wax | Altafin 125/130 | 10 |
| Vegetable Wax | Carnauba | 23 |
| Ester Wax | Hoechst V | 4 |
| Oil | Penreco 2251 | 5 |
| Antioxidant | Irganox 1076 | 1 |
| Plasticizer | Benzoflex 988 | 3 |
| SOLIDS MIX FORMULATION | | |
| Magnetic Pigment | Oxide MO-8029 | 36 |
| Inorganic Filler | Gamma Sperse | 4 |
| Wetting Agent | Soya Lecithin | 1.5 |
| Flow Enhancer | Antiterra U | 1.5 |

The ingredients of the heated mix, along with 80 grams (wet weight) of Lacolene solvent, are stirred and heated to approximately 80 degrees C. for about 10 minutes to enable the waxes to be melted and to be dispersed readily throughout the solvent based solution. This 80 degrees C. mixture is then placed into dispersion equipment such as a ball mill, a shot mill, an attritor or a sand mill along with the ingredients of the solids mix and along with 21 grams of a five percent solution of polyvinyl pyrrolidone in N-Propanol. The latter solution is made up of one gram of polyvinyl pyrrolidone, which added to the combined ingredients of the heated mix and of the solids mix totals 100 grams, and 20 grams of N-Propanol alcohol. The coating formulation is maintained at a temperature of approximately 55 degrees C. while being dispersed to insure proper mixture of the pigment and wetting thereof.

The substrate or base 22, which may be 40 gauge capacitor tissue, manufactured by Schweitzer, or 35 gauge polyester film, manufactured by duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The coating 24 is applied to the substrate 22 by means of a Meyer rod or like wire-wound doctor bar set up on a typical solvent coating machine to provide the coating weight of between 7.7 and 13.5 grams per square meter. The coating vessel or apparatus along with the transfer lines and the Meyer rod are maintained at a temperature of approximately 50 degrees C. to provide a coating viscosity sufficiently low to enable pumping of the material. The coating is made up of approximately 50% solid material and is maintained at the temperature and viscosity throughout the coating process. After the coating is applied to the substrate, the web of ribbon is passed through a dryer at the elevated temperature in the range between 93 and 150 degrees C. for approximately five to ten seconds to insure good adherence of the coating 24 onto the substrate 22 in making the transfer ribbon 20. The coating is applied by the Meyer rod to a thickness of five to fifteen microns.

EXAMPLE II

Example II describes the method of coating the substrate 22 to a coating weight in the range between 7.7 and 13.5 grams per square meter, and utilizing a heat sensitive transfer layer consisting of three basic mixtures, namely, a binder mix, a solids mix and a wax mix. A binder mix based on a 100 gram weight of raw coating, includes the following ingredients in the mixture.

| Material | Trade Name | Percent Dry Weight |
|---|---|---|
| BINDER MIX FORMULATION | | |
| Hydrocarbon resin | Picco 6100 | 10 |
| Polyethylene resin | AC-617 | 5 |
| Hydrocarbon oil | Penreco 2251 | 7 |
| SOLIDS MIX FORMULATION | | |
| Magnetic pigment | Oxide MO-8029 | 39 |
| Inorganic filler | Gamma Sperse | 4 |
| Wetting agent | Soya Lecithin | 1.5 |
| Flow Enhancer | Antiterra U | 1.5 |
| WAX MIX FORMULATION | | |
| Acid wax | Hoechst S | 28 |
| Ester wax | Hoechst V | 1.5 |
| Vegetable wax | Carnauba | 1.5 |

The binder mix is formulated by adding the hydrocarbon resin and the polyethylene resin as a mixture into solution. The solids are added to the solution and solubilized by mechanically mixing the ingredients while heating the mixture to approximately 80 degrees C. and holding this temperature for approximately ten minutes. The binder formulation is then allowed to cool to approximately 55 degrees C.

The binder mix and the solids mix are processed through a dispersion operation by use of a ball mill, a shot mill, an attritor or a sand mill along with 21 grams of the five percent solution of polyvinyl pyrrolidone in N-Propanol. The one gram of polyvinyl pyrrolidone, when added to the ingredients of the binder mix, of the solids mix and of the wax mix totals 100 grams. The mixture of binder mix and solids mix is ground for a period of five minutes to reduce the pigment agglomerates and to ensure good wetting of the pigment.

The wax mix formulation is added to and ground by the dispersion equipment to reduce the particle size and to cause dispersal of the wax particles throughout the coating. The mechanical action of the grinding process causes the temperature of the solution to be maintained at approximately 55 degrees C. during the grinding operation.

The finished solution or coating 24 is then applied to the substrate 22 in the manner as explained above and the setting or drying procedure is the last step of producing the coated ribbon 20. The setting or drying procedure consists of drying the coating 24 on the base 22 at a temperature in the range between 93 and 150 degrees C. for a period of 5 to 10 seconds.

EXAMPLE III

This example is a composition of the heat sensitive transfer layer or coating consisting of two basic mixtures, namely, a pigment mix and a hot wax mix. The pigment mix includes the following ingredients:

| Material | Trade Name | Percent Dry Weight |
|---|---|---|
| PIGMENT MIX FORMULATION | | |
| Magnetic Pigment | MO-4232 | 38 |
| Inorganic Filler | Gamma Sperse | 4 |
| Hydrocarbon Oil | Penreco 2251 | 4 |
| Wetting Agent | Soya Lecithin | 1 |
| Flow Enhancer | Antiterra U | 1 |
| HEATED MIX FORMULATION | | |
| Vinyl Resin | Elvax 210 | 3 |

-continued

| Material | Trade Name | Percent Dry Weight |
|---|---|---|
| Polyethylene Resin | AC-8 | 5 |
| Acid Wax | Hoechst S | 19 |
| Vegetable Wax | Carnauba | 7 |
| Amide Wax | Glyconol | 3 |
| Petroleum Wax | ALOF 0604 | 14 |
| Antioxidant | Irganox 1076 | 1 |

Picco 6100 is a low molecular weight, aromatic, non-polar, thermoplastic resin produced from petroleum derived monomers. Penreco 2251 is an acid treated, oil-like, distillate of petroleum hydrocarbons selected from the group having boiling points of 375–500 degrees F.

Initially, the ingredients of the pigment mix are placed in the dispersal unit along with 100 grams of Isopropanol solvent to thorougly wet out the pigment. The resin, wax and antioxidant ingredients of the hot wax or heated mix are combined and placed in an oven set at 150 degrees C. and heated for a period of 30 minutes. While the hot wax or heated mix is still being heated and at least maintained at a temperature at approximately 120 degrees C., the pigment mix is slowly added at a constant rate to the hot wax mix so as not to cool the wax mix below 93 degrees C. The 120 degrees C. temperature of the mixture causes the Isopropanol solvent to evaporate quickly and leaves only the solids of the pigment mix dispersed in the hot wax mix. The coating assumes a gel-like characteristic and is somewhat thixotropic so as to be fluid in form when subjected to shaking motion. It should be noted that the solvents and alcohols used in mixing the ingredients into solution are generally evaporated at a temperature of 95–100 degrees C.

The coating 24 is applied to the substrate 22 by means of the Meyer bar on a hot melt coater to the coating weight of between 7.7 and 13.5 grams per square meter. In this application, the coating vessel, the transfer lines, and the Meyer bar are maintained at a temperature of approximately 120 degrees C. to keep the viscosity as low as possible. It is noted that the web is heated also to provide heat to the coating between the pick-up roll and the nip between the surfaces to insure maximum fluidity at the Meyer bar. The substrate material and the drying procedure are the same as in the previous examples.

While the above examples provide the best modes for teaching and carrying out the invention and provide the highest quality print for the utilized technique, there are alternative methods of formulating at thermal transfer ribbon by incorporating portions of each example. One alternate method uses the binder mix of Example II and melting the wax, as described in Example I, and thereby formulating a hybrid coating. Another method uses the heated mix of Example I and, instead of melting the wax into the mix, grinding the waxes into a functional particle size as done in Example II. A third method involves evaporating the solvent from the mixture in Example I or II and coating the thixotropic mixture by means of the hot melt operation.

The availability of the various ingredients used in the present invention is provided by the following list of companies.

Magnetic Pigment—Pfizer Inc.
Inorganic Filler—Georgia Marble Co.
Wetting Agent—Rohm and Haas Co.
Flow Enhancer—Byk Mallinckrodt
Aliphatic Solvent—Ashland Chemical Co.
Hydrocarbon Oil—Penn. Refining Co.
Alcohol—Ashland Chemical Co.
Hydrocarbon Resin—Hercules Inc.
Polyethylene Resin—Allied Chemical Corp.
Vinyl Resin—DuPont De Nemours & Co.
Petroleum Wax—Dura Commodities Corp.
Vegetable Wax—International Wax Inc.
Ester Wax—American Hoechst Corp.
Antioxidant—Ciba-Geigy Ltd.
Plasticizer—Velsicol Chemical Corp.
Acid Wax—American Hoechst Corp.
Amide Wax—Glyco Chemicals Inc.

It should be noted that while the 35 or 40 gauge substrate is about 9–10 microns thick, a coating thickness of about 8–12 microns is preferred in the practice of the invention.

It is thus seen that herein shown and described is a ribbon for use in thermal printing operations which includes a thermal responsive magnetic coating on one surface thereof. The coated ribbon enables transfer of coating material onto documents or like record media during the printing operation to form characters thereon in an encoded nature, permitting machine reading of the characters. The present invention enables the accomplishment of the objects and advantages mentioned above, and while a preferred embodiment has been disclosed herein, variations thereof may occur to those skilled in the art. It is contemplated that all such variations and modifications not departing from the spirit and scope of the invention hereof are to be construed in accordance with the following claims.

I claim:

1. A thermal magnetic ribbon for use in non-impact printing comprising a substrate and a transfer layer which is a mixture containing about 3% to 10% hydocarbon resin as a binder material, about 1.5% to 5% hydrocarbon oil, about 15% to 50% wax, about 12% to 50% magnetic pigment in a ratio of about 4:1 with the hydrocarbon resin, about 1% wetting agent, all by dry weight, and about 30% to 60% solvent by wet weight for solubilizing the mixture.

2. The ribbon of claim 1 wherein the transfer layer consists of a coating weight about 7.7 grams/square meter to 13.5 grams/square meter.

3. The ribbon of claim 2 wherein the transfer layer is about 5 to 15 microns thick.

4. The ribbon of claim 1 wherein the transfer layer mixture contains about 2% additives by dry weight.

5. The ribbon of claim 1 wherein the transfer layer mixture contains about 4% ester wax, about 23% vegetable wax, and about 10% petroleum wax by dry weight.

6. The ribbon of claim 1 wherein the transfer layer mixture is a gel-like coating on the substrate and is subjected to an elevated temperature for setting thereof.

7. The thermal magnetic ribbon of claim 1 wherein the transfer layer mixture contains about equal amounts of wax and magnetic pigment.

8. The thermal magnetic ribbon of claim 1 wherein the transfer layer mixture contains hydrocarbon resin and a lesser amount of hydrocarbon oil.

9. The thermal magnetic ribbon of claim 1 wherein the transfer layer mixture contains about 10% hydrocarbon resin, about 37% petroleum, vegetable, and ester wax, about 5% hydrocarbon oil, about 3% plasticizer, about 36% magnetic pigment, about 4% inorganic filler, about 1% antioxidant, and about 1.5% each of wetting agent and flow enhancer.

10. The thermal magnetic ribbon of claim 9 wherein the transfer layer mixture includes about 1% polyvinyl pyrrolidone.

11. The thermal magnetic ribbon of claim 1 wherein the transfer layer mixture contains about 10% resin, about 31% acid, ester, and vegetable wax, about 7% hydrocarbon oil, about 39% magnetic pigment, about 4% inorganic filler, and about 1.5% each of wetting agent and flow enhancer.

12. The thermal magnetic ribbon of claim 11 wherein the transfer layer mixture includes about 1% polyvinyl pyrrolidone.

13. The thermal magnetic ribbon of claim 1 wherein the transfer layer mixture contains about 8% resin, about 43% acid, vegetable, amide, and petroleum wax, about 4% hydrocarbon oil, about 38% magnetic pigment, about 4% inorganic filler, and about 1% each of antioxidant, wetting agent and flow enhancer.

14. The thermal magnetic ribbon of claim 1 wherein each of the substrate and the transfer layer is about 10 microns thick.

15. The thermal magnetic ribbon of claim 1 wherein the binder material comprises hydrocarbon resin and polyethylene resin.

16. The thermal magnetic ribbon of claim 1 wherein the binder material comprises polyethylene resin and vinyl resin.

* * * * *